US006808542B2

(12) United States Patent
Nguyen et al.

(10) Patent No.: US 6,808,542 B2
(45) Date of Patent: Oct. 26, 2004

(54) PHOTOLUMINESCENT MARKERS AND METHODS FOR DETECTION OF SUCH MARKERS

(75) Inventors: My T. Nguyen, Kirkland (CA); Francois Raymond, Montreal (CA); Steven Xiao, Laval (CA)

(73) Assignee: American Dye Source, Inc., Quebec (CA)

( * ) Notice: Subject to any disclaimer, the term of this patent is extended or adjusted under 35 U.S.C. 154(b) by 0 days.

(21) Appl. No.: 10/025,830

(22) Filed: Dec. 26, 2001

(65) Prior Publication Data

US 2003/0154647 A1 Aug. 21, 2003

(51) Int. Cl.[7] ..... C10L 1/10

(52) U.S. Cl. ..... 44/300; 585/7; 585/10; 585/11; 585/14; 436/56

(58) Field of Search ..... 436/56; 585/7, 585/10, 11, 14; 44/300; 549/32; 548/125, 134, 416, 427; 564/305

(56) References Cited

U.S. PATENT DOCUMENTS 4,209,302 A 6/1980 Orelup
4,735,631 A 4/1988 Orelup
5,205,840 A 4/1993 Friswell et al.
5,498,808 A 3/1996 Smith
5,525,516 A 6/1996 Krutak et al.
5,807,974 A * 9/1998 Kim et al. ..... 528/366
5,876,864 A * 3/1999 Kim et al. ..... 428/690
5,902,750 A 5/1999 Fuerholzer et al.
5,980,593 A 11/1999 Friswell et al.
5,984,983 A 11/1999 Asgaonkar
6,344,286 B1 * 2/2002 Kim et al. ..... 428/690
6,372,154 B1 * 4/2002 Li ..... 252/301.16
6,399,224 B1 * 6/2002 Li ..... 428/690

* cited by examiner

*Primary Examiner*—Cephia D. Toomer
(74) *Attorney, Agent, or Firm*—Merek, Blackmon & Voorhees, LLC

(57) ABSTRACT

The invention provides photoluminescent markers consisting essentially of fluorene copolymers, which are colorless or nearly colorless to the naked eye and exhibit strong photoluminescence between about 380–800 nm upon exposure to ultra-violet radiation or laser light. The soluble fluorene copolymers described in this invention having a general formula as shown in Formula 1.

Formula 1 where:

$R_1$ and $R_2$ are $C_1$–$C_{24}$ linear or branched alkyl chain, n is the number of repeating unit, M is a co-monomer unit having structures chosen to impart distinct physical or chemical properties to the marker. Also provided in the present invention are methods of use of the markers for tagging solid or liquid products and methods to detect said markers.

15 Claims, 4 Drawing Sheets

PHOTOLUMINESCENT MARKERS AND METHODS FOR DETECTION OF SUCH MARKERS

FIELD OF INVENTION

This invention relates to photoluminescent chemical markers for tagging liquids or solids. More specifically, this invention relates to fluorene copolymer markers.

BACKGROUND OF THE INVENTION

There is a strong drive for manufacturers and taxing authorities to tag various solid or liquid products with silent markers. Silent markers are invisible to the naked eye and yet identify the product when simple testing procedures are used. These silent markers when used in liquids are miscible with the liquid to be tagged, are visually undetectable, should not affect the use and performance of the product and should be difficult to remove (e.g. by extraction, filtration, bleaching, reactive conversion). These markers must be easily identifiable by sampling and testing the product and, in some cases, quantifiable by the user.

These markers are commonly used to tag petroleum fuels in order to confirm grade quality and taxation status. Markers are required by government regulation in order to police the tax classification of interchangeable fuels such as diesel fuel, farm equipment fuel and heating oil. Markers are also useful for locating the origin of leaks in storage tanks, lubrication systems, liquid handling facilities, etc.

However, there is an increasing trend towards the use of markers in other liquid products including for example beverages such as soft drinks and alcohols, foodstuffs, paints, cosmetics, refrigerants, lubricants, pharmaceuticals, waxes, varnishes, solvents, polymers, bulk chemicals and rubbers. For example, name brand manufacturers of liquid products or those using inks to print brand name labels will wish to tag products to confirm grade quality throughout their distribution systems and to confirm origin of the product.

Furthermore, markers can also be introduced in solid during processing, in melts, castings or solid mixtures, or by coating or impregnating the solid with the marker. For example, electronic products could be marked by coating their outer or inner surfaces. As a further example, markers, which are solid at room temperature can be designed to melt at temperatures used for melting and molding plastics so that the marker can be processed with the melt. Another possibility is to provide the marker in a solution, introduce the solution in a melt or resin and evaporate the solvent so as to re-solidify the marker within the targeted product.

Thus, in general, markers will commonly be used to identify origin or grade of a given product. Silent markers will ideally be hard to remove or copy so as to foil attempts to remove or mimic the markers.

Although a number of photoluminescent markers are known, a main drawback is their lack of sensitivity at low concentrations. Prior art markers are usually deployed in liquids to be tagged in concentrations in the range of 1 to 100 ppm (parts per million, volume per volume). These concentrations are often high enough to negatively affect physical or chemical properties of the product to be tagged. For example, in the case of petroleum fuels, too much of a marker can cause engine malfunctions and deposits.

Thus, there is a need for highly sensitive markers capable of effectively tagging solids or liquids at concentrations in the range of ppb (parts per billion), which may be readily identified and preferably even quantified. From a cost standpoint, it is also preferable to use less of the chemical marker.

Another drawback of current chemical photoluminescent markers is a limited range of available solubility in different organic and inorganic liquids and a limited range of detectable photoluminescent responses.

Thus, there is a need for markers capable of solubilizing in many different liquids. There is also a need for markers capable or being easily designed so as to provide an extended range of detectable photoluminescent responses.

Yet another drawback is the need for many of the existing silent markers to be extracted by a wet chemical process. Typically, the chemical process includes shaking a sample of the product with a water-based reagent such as described in U.S. Pat. Nos. 4,209,302, 4,735,631, 5,205,840 and 5,902,750. The addition of a chemical agent to the water phase causes the extract to turn to a visibly distinct color. The depth of the color indicates the quantity of marker present in the sample. A laboratory measurement in a spectrometer indicates the concentration of marker present in the isolated sample. Comparing the measured concentration with the original concentration of marker in the fuel assists in the identification of the fuel, However, such technique involves disposal problems for the spent sample and is generally burdensome because of the various steps that have to be performed.

Also, some silent markers are large organic molecules that either absorb or fluoresce in the near infrared to mark their presence in a fuel sample. U.S. Pat. Nos. 5,498,808, 5,980,593 and 5,525,516, incorporated herein by reference. In U.S. Pat. Nos. 5,498,808 and 5,980,593, the presence of such silent marker is detected by firstly extracting the marker with an aqueous reagent and then exposing the extract to UV light to witness fluorescence. However, such multi-step procedure is generally burdensome. In U.S. Pat. No. 5,525,516 (squaraines, phthalocyanines and naphthalocyanines markers) and U.S. Pat. No. 5,984,983 (carbonyl markers) the presence of a silent marker is detected by exposing the marker to near infrared radiation and then detecting emitted fluorescent light via a near infrared light detection element. Although meritorious, these efforts have not lead to silent markers being sufficiently sensitive and versatile to properly function in various organic environments. Solubility problems, detection problems and stability problems are often encountered.

Therefore, there remains a great need for a novel class of silent markers which do not require extraction before testing, which fluoresce under simple testing conditions and at very low concentrations, which are soluble and non-reactive in a host of chosen liquids, preferably organic liquids, and which remain sufficiently stable over time whilst present in the organic liquid.

Preferably, the silent marker will be colorless or very lightly colored (will not fluorescence under normal lighting conditions). Also, the silent marker would preferably be essentially insoluble in aqueous media (i.e. less than about 0.2 per 100 ml at 20° C.) so as to make its removal via extraction difficult. Still preferably, the marker should be combustible when used to tag combustible fuels.

The invention is next described in connection with certain embodiments; however, it will be clear to those skilled in the art of petroleum product marking that various modifications, additions and subtractions can be made to the described embodiments without departing from the spirit or scope of the invention.

SUMMARY OF THE INVENTION

The invention provides fluorene-containing photoluminescent markers for identification purposes and methods for detection of such photoluminescent markers when present in organic liquid products or present in solid products. These novel markers are described in more detail with reference to preferred embodiments.

DETAILED DESCRIPTION OF CERTAIN PREFERRED EMBODIMENTS

Figure 1:
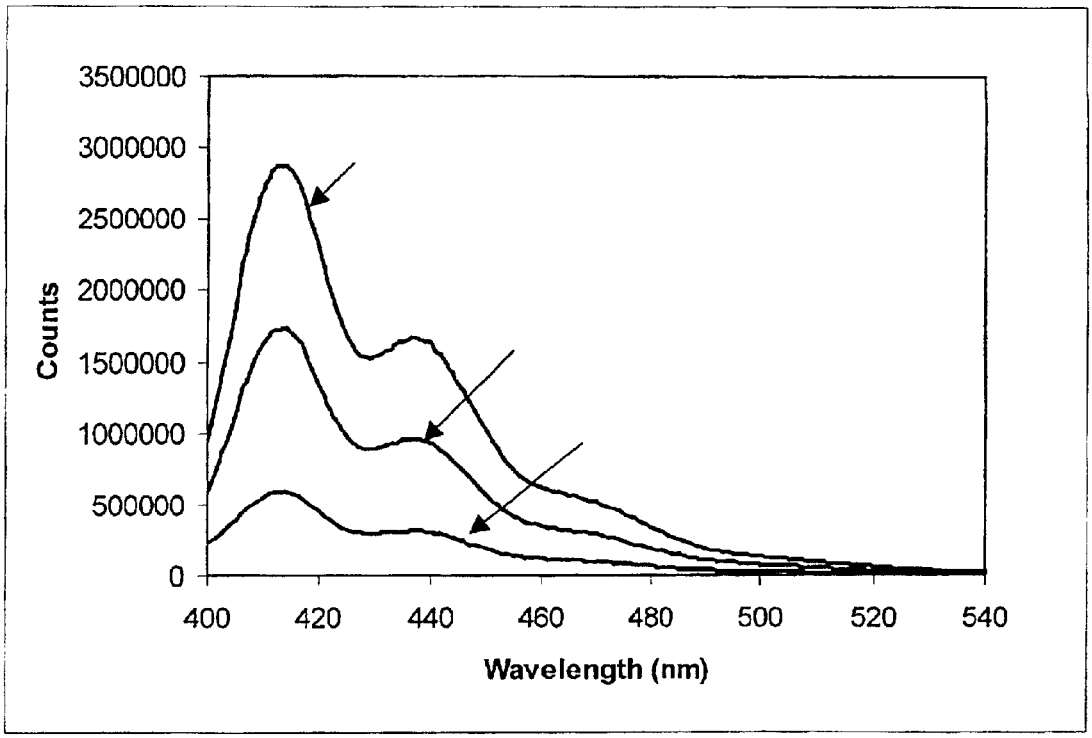
FIG. 1 shows the emission spectra of a copolymer of the present invention at various concentrations when dissolved in gasoline.

This invention relates to photoluminescent markers for identification purposes and methods for detection of such photoluminescent markers when present in organic or inorganic liquid products or solid products.

When used herein, the expression "organic liquid products" is meant to encompass non-aqueous liquid products containing essentially organic molecules and blends thereof.

More specifically, this invention relates to fluorene copolymers as photoluminescent markers, which are colorless to naked eyes and exhibit strong photoluminescence between about 380–800 nm upon exposure to ultra-violet radiation or laser light. The soluble fluorene copolymers described in this invention having a general formula as shown in Formula 1.

Formula 1

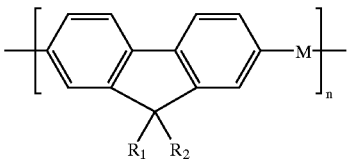

Where:

$R_1$ and $R_2$ are $C_1$–$C_{24}$ linear or branched alkyl chain, n is the number of repeating unit, M is a co-monomer unit having the following structures:

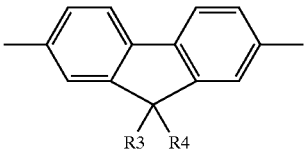

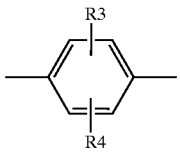

-continued

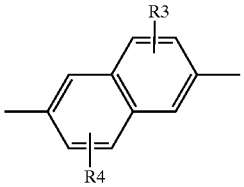

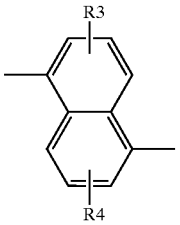

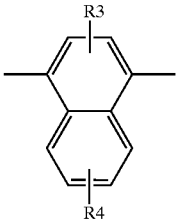

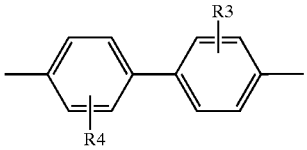

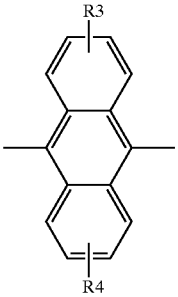

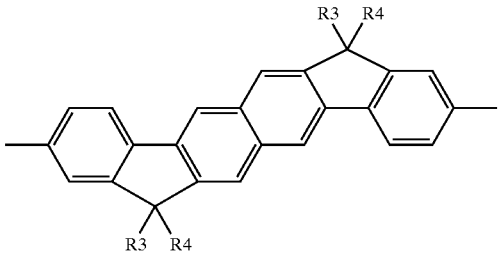

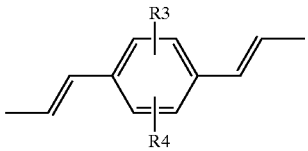

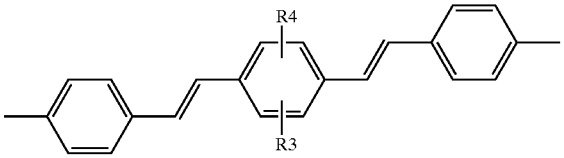

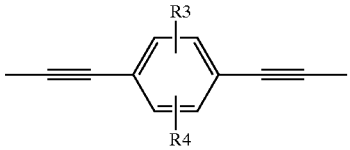

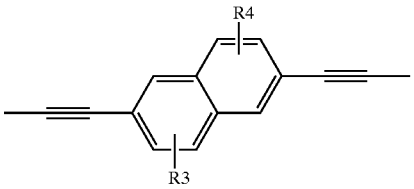

-continued

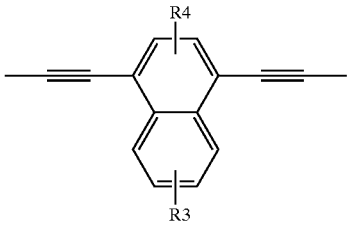

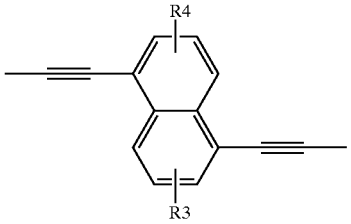

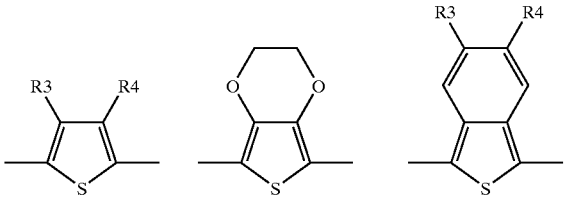

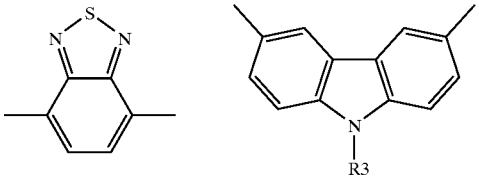

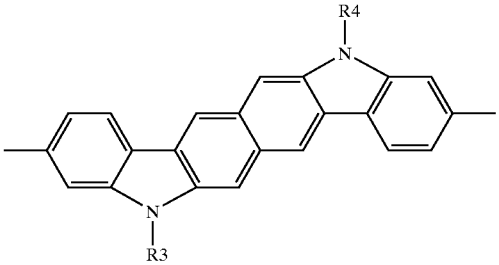

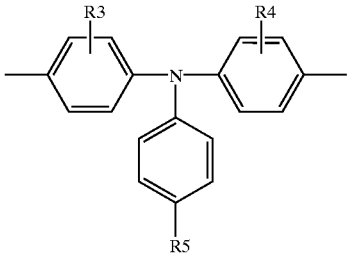

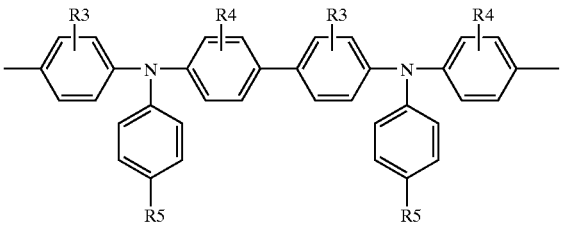

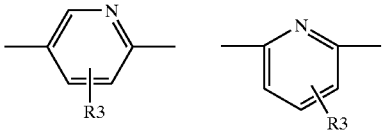

-continued

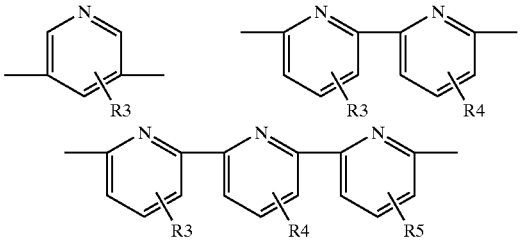

Wherein:

$R_3$, $R_4$ and $R_5$ are hydrogen, $C_1$–$C_{12}$ linear or branched alkyl, alkylene, alkyloxy, hydroxy alkyl, amino alkyl, cyanato alkyl, mercaptoalkyl, or poly(oxyalkylene) ether.

The terms "alkyl", "alkylene", "alkyloxy" refer to $C_1$–$C_{12}$ groups.

Each fluorene copolymer described in this invention exhibits unique absorption and photoluminescent characteristics. These characteristics are key parameters for detection methods of this invention. The fluorene copolymer also exhibit solubility and melting points which can vary depending on the chosen $R_1$ and $R_2$ groups in formula 1.

The following examples illustrate the syntheses of a wide variety of fluorene copolymers, which are useful in the practice of this invention. All the syntheses were performed using a three-neck flask, which was equipped with magnetic stirrers, heating mantle, temperature controller, water condenser and nitrogen gas inlet. The products were characterized with spectrofluorometer (available from Photon Technology International, Model QM2000), spectrometer (available from Shimadzu, Model PC-1201), differential scanning calorimeter (Instrument Specialties, Model DSC-500). The molecular weights of fluorene copolymers were determined by gel permeable chromatography (available from Waters, Model Breeze-System, equipped with 2410 reflective index detector). The molecular weight of fluorene copolymers was evaluated using tetrahydrofuran as eluent and polystyrene standards.

EXAMPLE 1

Synthesis of poly[2,7-(9,9-dihexyl)fluorene-co-2,7-(9,9-(di-5-pentenyl)fluorene)]

Poly[2,7-(9,9-dihexyl)fluorene-co-2,7-(9,9-(di-5-pentenyl)fluorene)] was obtained by adding 0.54 mmol of 2,7-diborolane-9,9-dihexylfluorene (available from American Dye Source, Inc., Baie D'Urfe, Quebec, Canada), 0.54 mmol of 2,7-dibromo-9,9-di(5-pentenyl)fluorene (available from American Dye Source, Inc., Baie D'Urfe, Quebec, Canada), 0.28 grams of triphenylphosphine (available from Sigma-Adrich, Oakville, Ontario, Canada) and 0.056 grams of palladium (II) diacetate (available from Sigma-Adrich, Oakville, Ontario, Canada) into 50 ml of freshly distilled tetrahydrofuran. The mixture was stirred at room temperature for 15 min. A solution containing 2 molar of potassium carbonate (15 ml) was added to the reaction flask and the mixture was heated to reflux for 18 hours. The reaction mixture was then extracted with toluene. The organic phase was washed with brine three time and dried over sodium sulfate. Removal of solvent gave a dark green gum. The crude product was purified by dissolution into 50 ml of toluene solution containing 1.0 gram of silica gel (flash grade), 1.0 gram of neutral aluminum oxide and 1.0 gram of potassium cyanide. The mixture was stirred for 72 h. and the solid metal oxide particles were then removed by vacuum filtration. The filtrate was then removed by using a vacuum evaporator until dryness. The solid polymer product was dissolved in 3 ml of dichloromethane and then precipitated in 75 ml of acetone. A light beige polymeric powder was obtained by filtration and drying in a vacuum oven with 68% yield. The molecular weight of the obtained polymer was determined to be 15,000 versus polystyrene standards. The structure of Poly[2,7-(9,9-dihexyl)fluorene-co-2,7-(9,9-(di-5-pentenyl)-fluorene)] is shown as the following.

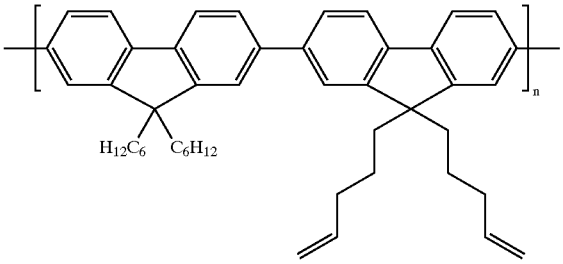

EXAMPLE 2

Synthesis of poly[(2,7-{9,9-dihexylfluorene})-co-(1,4-benzene)]

The synthesis of poly[(2,7-{9,9-dihexylfluorene})-co-(1,4-benzene)] was performed similarly to that of example 1, excepted that 1,4-dibromobenzene (available from Sigma-Aldrich, Oakville, Ontario, Canada) was used to replace 2,7-dibromo-9,9-di(5-pentenyl)fluorene. A white polymeric powder was obtained with 22% yield. The molecular weight of the obtained polymer was determined to be 10,000 versus polystyrene standards. The structure of poly[(2,7-{9,9-dihexylfluorene})-co-(1,4-benzene)] is shown as the following.

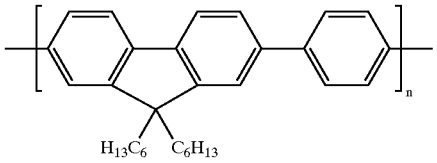

EXAMPLE 3

Synthesis of poly[(2,7-{9,9-dihexylfluorene})-co-(1,4-{2,5-dimethyl}-benzene)]

The synthesis of poly[(2,7-{9,9-dihexylfluorene})-co-(1,4-{2,5-dimethyl}-benzene)] was performed similarly to that of example 1, excepted that 2,5-dibromo-p-xylene (available from Sigma-Aldrich, Oakville, Ontario, Canada) was used to replace 2,7-dibromo-9,9-di(5-pentenyl)fluorene. A white polymeric powder was obtained with 22% yield. The molecular weight of the obtained polymer was determined to be 9,000 versus polystyrene standards. The structure of poly[(2,7-{9,9-dihexylfluorene})-co-(1,4-{2,5-dimethyl}-benzene)] is shown as the following.

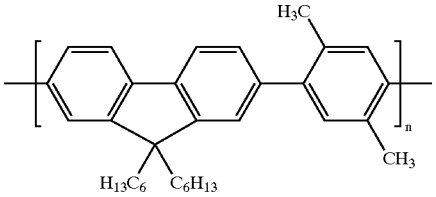

EXAMPLE 4

Synthesis of poly[(2,7-{9,9-dihexyl}-fluorene)-co-(4,4'-biphenyl)]

The synthesis of poly[(2,7-{9,9-dihexylfluorene})-co-(4,4'-{1,1'-biphenyl})] was performed similarly to that of example 1, excepted that 4,4'-dibromo-1,1'-biphenyl (available from Sigma-Aldrich, Oakville, Ontario, Canada) was used to replace 2,7-dibromo-9,9-di(5-pentenyl)fluorene. A white polymeric powder was obtained with 70% yield. The molecular weight of the obtained polymer was determined to be 6,000 versus polystyrene standards. The structure of poly[(2,7-{9,9-dihexyl}-fluorene)-co-(4,4'-biphenyl)] is shown as the following.

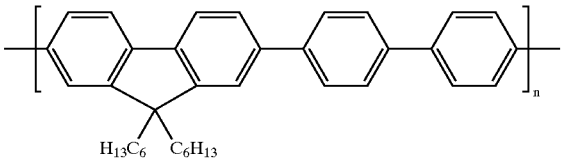

EXAMPLE 5

Synthesis of poly[(2,7-{9,9-dihexyl}-fluorene)-co-(9,10-anthracene)]

The synthesis of poly[(2,7-{9,9-dihexyl}-fluorene)-co-(9,10-anthracene)] was performed similarly to that of example 1, excepted that 9,10-dibromoanthracene (available from Sigma-Aldrich, Oakville, Ontario, Canada) was used to replace 2,7-dibromo-9,9-di(5-pentenyl)fluorene. A light yellow polymeric powder was obtained with 20% yield. The molecular weight of the obtained polymer was determined to be 4,000 versus polystyrene standards. The structure of poly[(2,7-{9,9-dihexyl}-fluorene)-co-(9,10-anthracene)] is shown as the following.

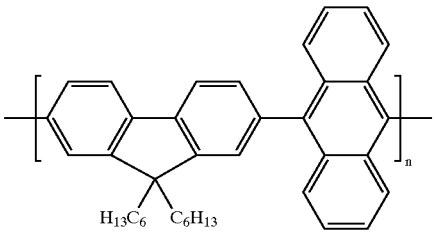

EXAMPLE 6

Synthesis of poly[(2,7-{9,9-dihexylfluorene})-co-(1,4-benzo-{2,1',3}-thiadiazole)]

The synthesis of poly[(2,7-{9,9-dihexyl}-fluorene)-co-(1,4-benzo-{2,1',3}-thiadiazole)] was performed similarly to that of example 1, excepted that 1,4-dibromo-[2,1',3]-thiadiazole (available from American Dye Source, Inc., Baie D'Urfe, Quebec, Canada) was used to replace 2,7-dibromo-9,9-di(5-pentenyl)fluorene. A light yellow polymeric powder was obtained with 60% yield. The molecular weight of the obtained polymer was determined to be 10,000 versus polystyrene standards. The structure of poly[(2,7-{9,9-dihexyl}-fluorene)-co-(1,4-benzo-{2,1',3}-thiadiazole)] is shown as the following.

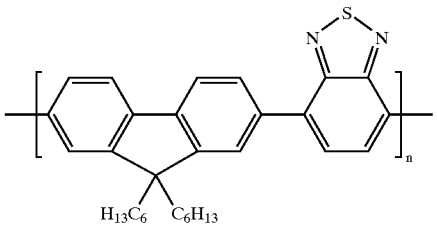

EXAMPLE 7

Synthesis of poly[2,7-(9,9-{dihexylfluorene})-co-({9-ethyl}-3,6-carbazole)]

The synthesis of poly[2,7-(9,9-{dihexylfluorene})-co-({9-ethyl}-3,6-carbazole)] was performed similarly to that of example 1, excepted that 9-ethyl-3,6-dibromocarbazole (available from American Dye Source, Inc., Baie D'Urfe, Quebec, Canada) was used to replace 2,7-dibromo-9,9-di(5-pentenyl)fluorene. A light yellow polymeric powder was obtained with 60% yield. The molecular weight of the obtained polymer was determined to be 10,000 versus polystyrene standards. The structure poly[2,7-(9,9-{dihexylfluorene})-co-(3,6-{9-ethyl}-carbazole)] is shown as the following.

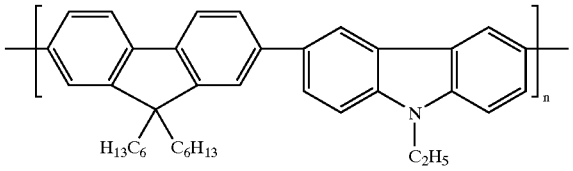

EXAMPLE 8

Synthesis of poly[2,7-(9,9-{dihexylfluorene})-co-(3,5-pyridine)]

The synthesis of poly[2,7-(9,9-{dihexylfluorene})-co-(3,5-pyridine)] was performed similarly to that of example 1, excepted that 3,5-dibromopyridine (available from Sigma-Aldrich, Oakville, Ontario, Canada) was used to replace 2,7-dibromo-9,9-di(5-pentenyl)fluorene. A white polymeric powder was obtained with 30% yield. The molecular weight of the obtained polymer was determined to be 7,000 versus polystyrene standards. The structure poly[2,7-(9,9-{dihexylfluorene})-co-(3,5-pyridine)] is shown as the following.

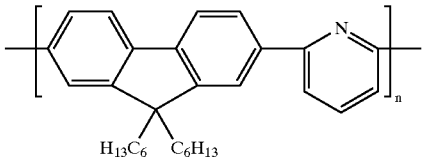

EXAMPLE 9

Synthesis of poly[2,7-(9,9-{dihexyl}-fluorene)-co-(N,N'-di{phenyl}-N,N'-di{p-butylphenyl}-1,4-diaminobenzene)]

The synthesis of poly[2,7-(9,9-{dihexyl}-fluorene)-co-(N,N'-di{phenyl}-N,N'-di{p-butylphenyl}-1,4-diaminobenzene)] was performed similarly to that of example 1, excepted that N,N'-di(p-bromophenyl)-N,N'-di(p-butylphenyl)-1,4-diaminobenzene (available from American Dye Source, Inc., Baie D'Urfe, Quebec, Canada) was used to replace 2,7-dibromo-9,9-di(5-pentenyl)fluorene. A beige polymeric powder was obtained with 30% yield. The molecular weight of the obtained polymer was determined to be 6,000 versus polystyrene standards. The structure poly[2,7-(9,9-{dihexyl}-fluorene)-co-(N,N'-di{phenyl}-N,N'-di{p-butylphenyl}-1,4-diaminobenzene)] is shown as the following.

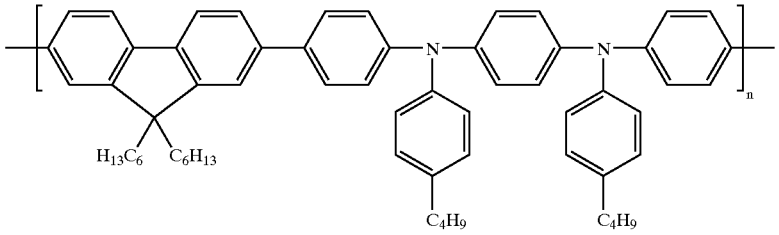

EXAMPLE 10

Synthesis of poly[(9,9-dioctylfluorenyl-2,7-diyl)-co-(1,4-vinylenephenylene)]

The synthesis of poly[(9,9-dioctylfluorenyl-2,7-diyl)-co-(1,4-vinylenephenylene)] was performed by dropwise adding tri-n-ethyllamine (7.0 ml) into 100 ml N,N-dimethylformamide solution containing 1.3 gram of p-divinylbenzene (available from Sigma-Aldrich, Oakville, Ontario, Canada), 5.5 gram of 2,7-dibromo-9,9-dioctylfluorene (available from American Dye Source, Inc., Baie D'Urfe, Quebec, Canada), 0.1 gram of palladium (II) acetate (available from Sigma-Aldrich, Oakville, Ontario, Canada) and 0.63 gram of tri-o-tolylphosphine (available from Sigma-Aldrich, Oakville, Ontario, Canada). The reaction mixture was stirred at 100° C. for 24 hours under nitrogen atmosphere. The reaction mixture was cooled to room temperature and pour into 2 liter of methanol. The precipitate polymer was collected by filtration. The polymer was further purified by precipitated into 2 liter of acetone from tetrahydrofuran solution. A light yellow power polymer was obtained with 62% yield after filtration and dried in air. The molecular weight of the obtained polymer was determined to be 20,000 versus polystyrene standards. The structure of poly[(9,9-dioctylfluorenyl-2,7-diyl)-co-(1,4-vinylenephenylene)] is shown as the following:

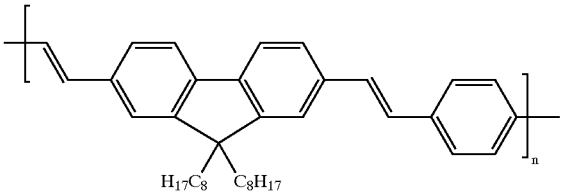

EXAMPLE 11

Synthesis of poly[(9,9-dioctylfluorenyl-2,7-diyl)-co-(ethylenylbenzene)]

The synthesis of poly[(9,9-dioctylfluorenyl-2,7-diyl)-co-(ethylenylbenzene)] was performed by adding 20 ml triethylamine into 100 ml toluene solution containing 1.4 gram of 1,4-diethynylbenzene (available from TCI, Portland, Oreg.), 5.5 gram of 2,7-dibromo-9,9-dioctylfluorene, 0.4 gram of bistriphenylphosphine palladium dichloride, 1.0 gram of copper (I) iodide and 0.3 gram triphenylphosphine in a Schlenk tube under nitrogen atmosphere. The mixture was heated at 70–80° C. for 24 hours. The reaction mixture was cooled to room temperature and poured into 2 liter of methanol. The precipitated polymer was collected by filtration and washed copiously with methanol. The precipitate polymer was collected by filtration. The polymer was further purified by precipitation into 2 liter of acetone from tetrahydrofuran solution. A light yellow fiber product was obtained with 54% yield after filtration and dried in air. The molecular weight of the obtained polymer was determined to be 10,000 versus polystyrene standards. The structure of poly[(9,9-dioctylfluorenyl-2,7-diyl)-co-(ethylenylbenzene)] is shown as the following:

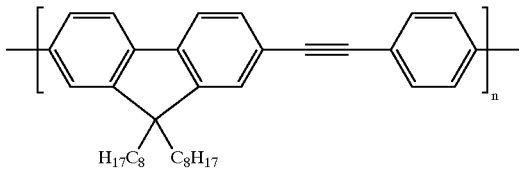

Method of Use

The present invention also provides a method for marking various organic liquid products for subsequent identification purposes. The markers of the present invention are fluorene copolymers, which are used to tag or mark chosen organic liquids. When samples of a tagged product are exposed to UV radiation or laser light, i.e. at the wavelength between about 200 to 500 nm, preferably 325 to 400 nm. A photodetector can be used to measure the spectral pattern of fluorescent emissions (emission vs. wavelength). The fluorescence and its color will become immediately visible to the naked eye and will constitute a first indication of the presence of the marker. Also, a spectrofluorometer can be used to measure the concentration of the fluorescence emitting substance upon comparison with a standard calibration curve.

Furthermore, the spectral pattern collected by the spectrofluorometer, in particular the maximum emission peak, will indicate of the exact marker used when the pattern is compared to a database of known spectral patterns. This is done by standard algorithms present in commercial available photodetection equipment known to those of skill in the art.

The absorbance reading obtained by photodetector readings will indicate the concentration of marker in a given sample. This will in turn immediately reveal if the sample was tampered with, blended, diluted, etc. Indeed, the concentration can be compared to an expected value. If the concentration differs from the expected value by a predetermined margin, the person testing the sample will immediately know that the organic liquid was tampered with. For example, if two grades of fuel have been blended in an effort to pass off the blend as a higher grade fuel, a photodetector reading of a blend sample will reveal the presence of both individual markers for each fuel grade and moreover will show both individual markers in concentrations lower than expected. This will immediately alert the tester and reveal exactly which fuel grades were blended and in approximately what ratio.

Because the markers of the present invention exhibit distinct spectral signatures, a plurality of markers may be used at the same time in a given organic liquid. For example, multiple markers could be used to indicate source of manufacture, approximate date of manufacture, grade, etc. To indicate a date of manufacture, for example on a month-to-month basis, twelve distinct markers could be used on a rotational basis.

As shown in Table 1, the various example compounds 1 through 11 of the present invention were individually used to tag kerosene. All compounds were placed in concentrations of about 100 ppb in Cyclosol-53™, available from Shell Canada Inc. Samples of each tagged kerosene fluids were first subjected to a spectrophotometer reading to obtain their absorption spectral signature. The wavelengths corresponding to the main peaks absorption peaks are listed in the second column. Each sample was then subjected to UV radiation by exposure to light generated by solid-state lasers (preferably 325 to 400 nm, the particular choice of laser is not crucial, for example He-Cd, Ag, GaN or other lasers are suitable). All of the samples had visually detectable fluorescence. The samples were subjected to a second spectrophotometer reading to obtain their fluorescence spectral signature. The wavelengths corresponding to the main absorption peaks are listed in Table 1. In a separate column, the Stoke shift or variation in the wavelength of the main absorption peaks for each sample is also provided. The Stoke shift is clearly large enough to readily allow detection of fluorescence. Upon standing for several weeks none of the fluorene copolymer compounds of the present invention had settled or crystallized.

It is to be understood that among the various fluorene copolymers of the present invention, these will be selected to avoid overlap in the fluorescence wavelengths of the main peaks of the organic substance being tagged.

TABLE 1

Absorption and photoluminescent wavelengths and colors of fluorene copolymers in Cyclosol-53 (trademark of Kerosene product, available from Shell Canada Inc.)

| | Absorption | | Photoluminescence | | Stoke Shift |
|---|---|---|---|---|---|
| Examples | λ (nm) | Color | λ (nm) | Color | Δλ (nm) |
| 1 | 385 | Colorless | 418 | Blue | 33 |
| 2 | 371 | Colorless | 407 | Violet-Blue | 36 |
| 3 | 324 | Colorless | 380 | Violet-Blue | 56 |
| 4 | 363 | Colorless | 405 | Violet-Blue | 42 |
| 5 | 400 | Colorless | 434 | Blue | 34 |
| 6 | 440 | Light Yellow | 521 | Green-Yellow | 81 |
| 7 | 347 | Colorless | 372 | Violet-Blue | 25 |
| 8 | 337 | Colorless | 369 | Violet | 32 |
| 9 | 362 | Light Yellow | 461 | Green | 99 |
| 10 | 401 | Light Yellow | 450 | Green | 49 |
| 11 | 374 | Colorless | 411 | Blue | 37 |

Evidence of Photoluminescence at Low Concentrations

Figure 2:
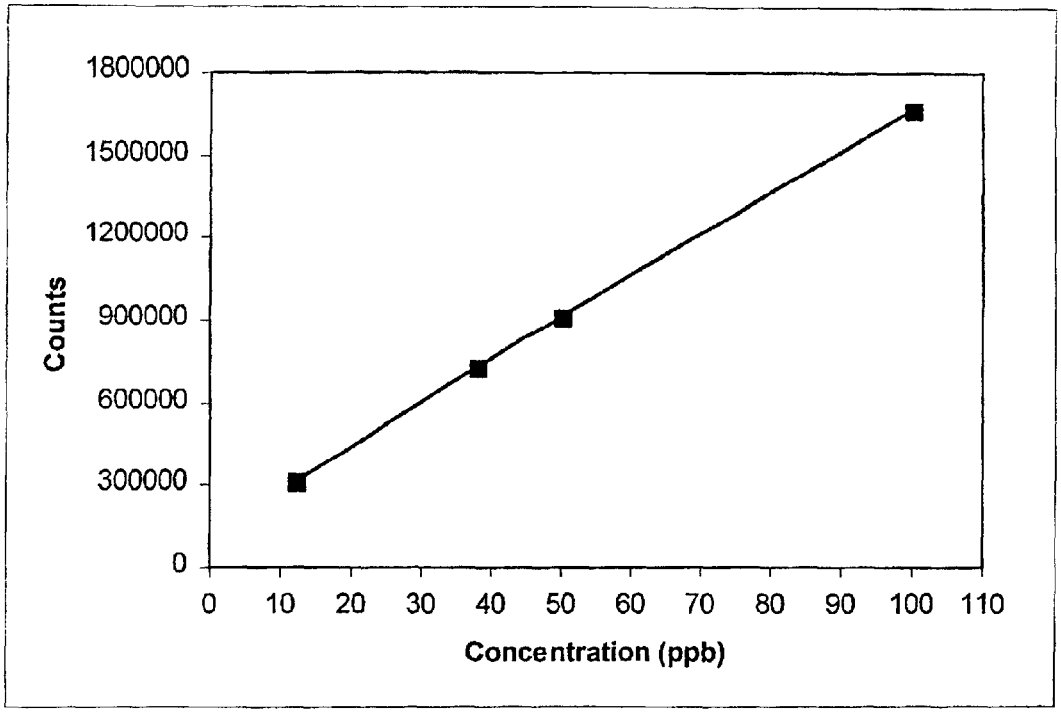
FIG. 2 shows the plot of concentration versus absorbance corresponding to the data of FIG. 1.

Referring now to FIGS. 1 and 2, evidence of photoluminescence at very low concentration is demonstrated. The compound of example 1, namely, poly[2,7-(9,9-dihexyl) fluorene-co-2,7-(9,9-(di-5-pentenyl)fluorene)] was placed in samples of Cyclosol-53™ at various concentrations, namely 12, 50 and 100 ppb (parts per billion, vol/vol basis). Even at these very low concentrations, the fluorescent intensity of these samples was clearly detectable as shown on FIG. 1. As can be seen from FIG. 2, the emission, measured in counts on the vertical axis of FIGS. 1 and 2 can be used to plot the concentration of the marker against a given standard calibration curve. It is to be understood that each fluorene copolymer compound of the present invention will exhibit particular fluorescent variation with varying concentration.

Figure 3:
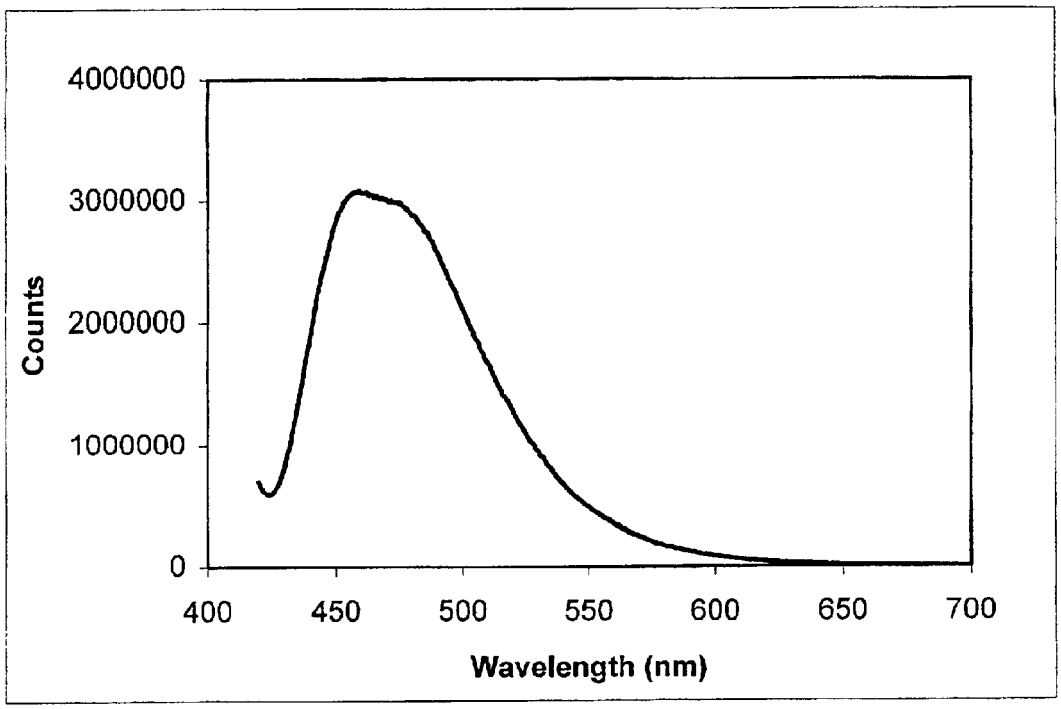
FIG. 3 shows the emission spectrum (corresponding to bright green visible color) upon exposure to UV light of a polyethylene plastic bag when tagged with a fluorene copolymer of the present invention.

The fluorene copolymers of this invention can be used to tag solid products such as sheets, tubing, containers, packaging boxes, bag, coatings and others, which are made from plastics, polymeric composites, wax, and paper. For example, poly[(9,9-dioctylfluorenyl-2,7-diyl)-co-(1,4-vinylenephenylene)], which was obtained from Example 10, was incorporated into high density polyethylene and extruded at 160° C. to produce polyethylene plastic bag. Upon exposure to UV light, the tagged polyethylene emits intensive green light. Upon exposure to violet laser light at 410 nm wavelength, the tagged polyethylene film also emits green light having a maximum at 460 nm as shown in FIG. 3.

Figure 4:
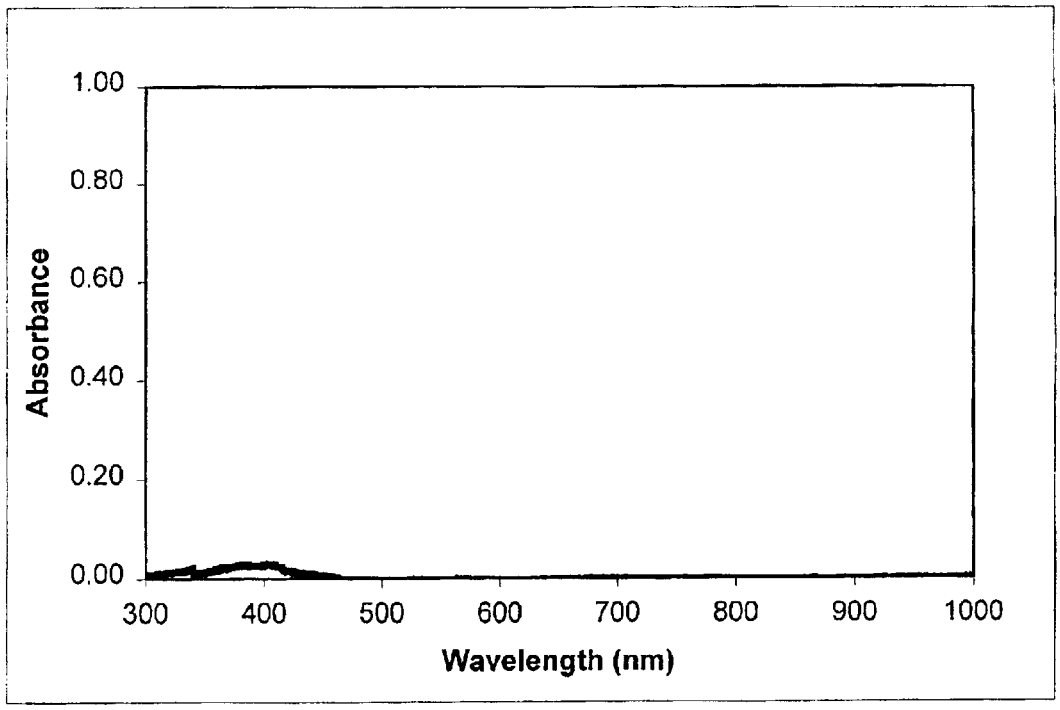
FIG. 4 shows the absorption spectrum of the same tagged polyethylene plastic bag which shows colorless under normal room light as indicated by a very low absorption.

On the other hand, the same tagged polyethylene plastic bag shows colorless under normal room light as indicated by a very low absorption in the UV-Vis-NIR spectrum as shown in FIG. 4.

Incorporating the fluorene copolymers of the present invention into polymeric solids can be performed by various methods such as melt mixing, dissolution in a solvent and subsequent mixing with the polymer melt, solid-solid mixing, dissolution in monomeric liquid prior to polymerization. It is to be understood that in the case of melt mixing, the $R_1$ and $R_2$ groups of the fluorene polymer of the present invention may be chosen so as to impart a melting point to the fluorene polymer which is compatible with the melt processing temperatures of the polymer into which the fluorene polymer is mixed.

The fluorene polymers of the present invention can also be incorporated onto or into various solids by coating, printing, prickling, impregnation, solid-solid mixing, etc.

What is claimed is:

1. Photoluminescent marker compound comprising fluorene copolymers, said fluorene copolymers being colorless or nearly colorless upon exposure to ambient light and being photoluminescent between about 380 and 800 nm upon exposure to ultra-violet radiation or laser light, said fluorene copolymers having a general formula as follows:

Formula 1

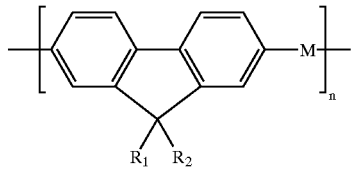

wherein:

$R_1$ and $R_2$ are $C_1$–$C_{24}$ linear or branched alkyl chain, n is the number of repeating unit, M is a co-monomer unit having the following structures:

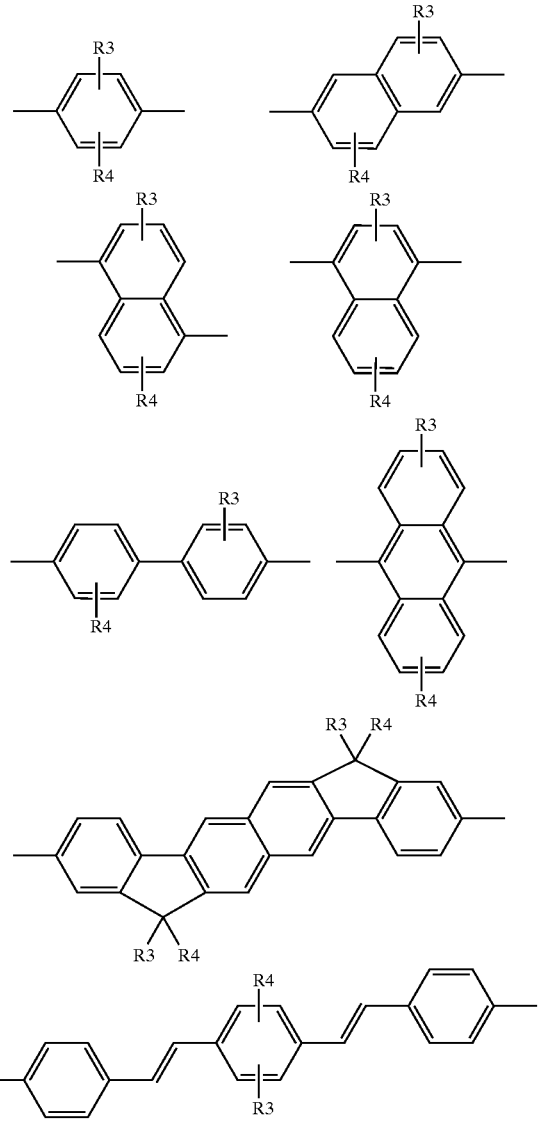

-continued

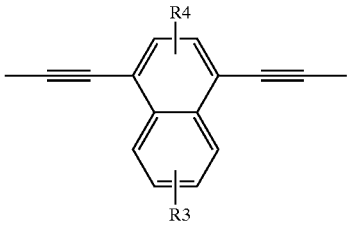

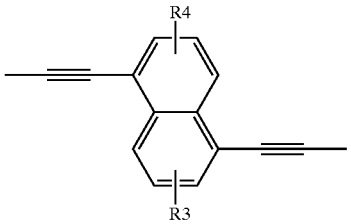

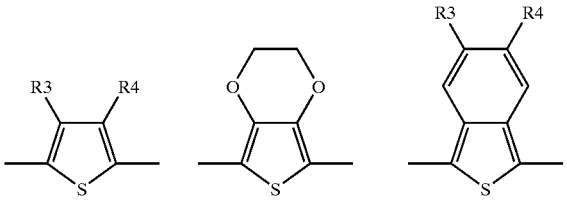

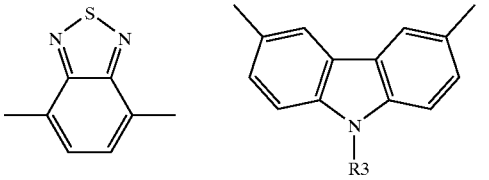

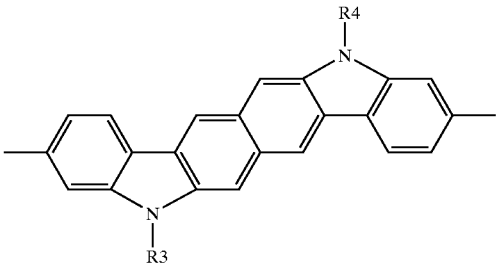

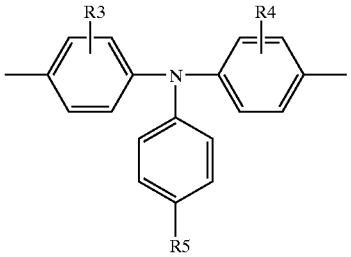

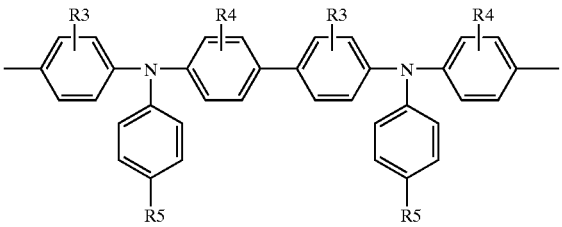

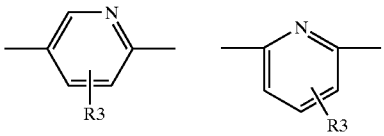

-continued

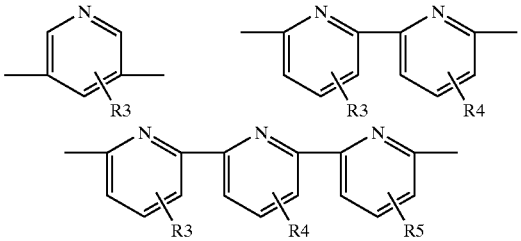

wherein:

$R_3$, $R_4$ and $R_5$ are hydrogen, $C_1$–$C_{12}$ linear or branched alkyl, alkylene, alkyloxy, hydroxy alkyl, amino alkyl, cyanato alkyl, mercaptoalkyl, or poly(oxyalkylene) ether.

2. The photoluminescent marker of claim 1 wherein M is

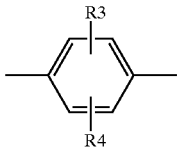

3. The photoluminescent marker of claim 1 wherein M is

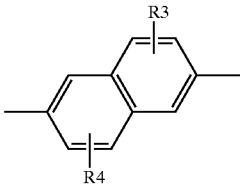

4. The photoluminescent marker of claim 1 wherein said marker is soluble in liquid organic products for tagging bulk liquid organic products.

5. The photoluminescent marker of claim 4 wherein said liquid organic product is a combustible fuel.

6. The photoluminescent marker of claim 5 wherein said combustible fuel is gasoline.

7. The photoluminescent marker of claim 4 wherein said marker is essentially insoluble in aqueous media so as to prevent removal by aqueous solvent extraction.

8. Method of tagging bulk liquid organic products comprising the steps of:

(a) dissolving in a given amount of said bulk liquid organic product a known amount of at least one fluorene copolymer as defined in claim 1 so as to achieve known concentrations of fluorene copolymers in said bulk liquid organic product;

(b) recording the identity of said at least one fluorene copolymers and their corresponding known concentrations for eventual testing to insure that the bulk liquid organic product remains unadulterated.

9. Method of identifying the contents of a bulk liquid organic product tagged with a marker comprising at least one fluorene copolymer as defined in claim 1, wherein said fluorene copolymer is soluble in said liquid organic product, said method comprising the steps of testing the bulk liquid organic product by:

(a) subjecting a portion of said bulk liquid organic product to ultraviolet radiation or laser light at wavelengths between about 200 and 500 nm;

(b) collecting emitted spectrum of the portion of liquid of step (a) with a photometer;

(c) comparing the spectrum to a library of known spectra of tagging markers so as to obtain a most probable match thereby establishing the identity of said marker;

(d) comparing the marker to a library of bulk liquid organic product markers linked to specific bulk liquid organic products thereby establishing the identity of said the bulk organic liquid being tested.

10. Method of tagging solid products comprising the steps of:

(a) mixing a known amount of at least one fluorene copolymer as defined in claim 1 with a solid so as to achieve known concentrations of fluorene copolymers in said solid;

(b) recording the identity of said at least one fluorene copolymers and their corresponding known concentrations for eventual testing to insure that the said solid product remains unadulterated.

11. The method of claim 10 wherein the solid being tagged is a bulk material and the mixing step (a) is effected by solid state blending of a solid copolymer of claim 1 and the solid being tagged.

12. The method of claim 10 wherein the solid being tagged is a polymeric material and the mixing step (a) is effected by melt mixing of a melt of a copolymer of claim 1 and the polymer melt which will yield the polymeric solid upon eventual cooling.

13. The method of claim 10 wherein the solid being tagged is a polymeric material and the mixing step (a) is effected by melt mixing by dissolving a copolymer of claim 1 in a suitable solvent and introducing said dissolved copolymer in the polymer melt which will yield the polymeric solid upon eventual cooling.

14. Method of tagging solid products comprising the steps of:

(a) dissolving a known amount of at least one fluorene copolymer as defined in claim 1 in a suitable solvent so as to obtain a tagged solvent;

(b) applying said tagged solvent to said solid product so as to tag said solid product;

(c) recording the identity of said at least one fluorene copolymers and their corresponding known concentrations for eventual testing to insure that the solid product remains unadulterated.

15. Method of identifying the contents of a solid product tagged with a marker comprising at least one fluorene copolymer as defined in claim 1, said method comprising the steps of testing the solid product by:

(a) subjecting a portion of said tagged solid to ultraviolet radiation or laser light at wavelengths between about 200 and 500 nm;

(b) collecting emitted spectrum obtained in step (a) with a photometer;

(c) comparing the spectrum to a library of known spectra of tagging markers so as to obtain a most probable match thereby establishing the identity of said marker;

(d) comparing the marker to a library of solid product markers linked to specific solids thereby establishing the identity or origin of said solid product being tested.

* * * * *